US009736573B2

(12) United States Patent
Ma et al.

(10) Patent No.: US 9,736,573 B2
(45) Date of Patent: Aug. 15, 2017

(54) SOUND SYSTEM

(71) Applicant: BOE TECHNOLOGY GROUP CO., LTD., Beijing (CN)

(72) Inventors: Yongda Ma, Beijing (CN); Yuxin Zhang, Beijing (CN); Jian Xu, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 0 days.

(21) Appl. No.: 14/914,221

(22) PCT Filed: Jul. 31, 2015

(86) PCT No.: PCT/CN2015/085729

§ 371 (c)(1),
(2) Date: Feb. 24, 2016

(87) PCT Pub. No.: WO2016/165240

PCT Pub. Date: Oct. 20, 2016

(65) Prior Publication Data

US 2017/0064439 A1 Mar. 2, 2017

(30) Foreign Application Priority Data

Apr. 17, 2015 (CN) ..... 2015 2 0236213 U

(51) Int. Cl.

| | |
|---|---|
| ***H04R 1/20*** | (2006.01) |
| ***H04R 1/28*** | (2006.01) |
| ***H04R 1/02*** | (2006.01) |

(52) U.S. Cl.

CPC ..... *H04R 1/2811* (2013.01); *H04R 1/025* (2013.01); *H04R 1/20* (2013.01); *H04R 1/2857* (2013.01)

(58) Field of Classification Search

CPC ..... H04R 1/26; H04R 1/227; H04R 1/345; H04R 1/403; H04R 1/2819; H04R 3/12; H04R 9/025; H04R 2499/13

See application file for complete search history.

(56) References Cited

U.S. PATENT DOCUMENTS

| | | | | |
|---|---|---|---|---|
| 3,938,617 A * | 2/1976 | Forbes | ..... | H04R 1/025 181/148 |
| 2009/0190788 A1* | 7/2009 | Yang | ..... | H04R 1/021 381/386 |
| 2012/0027240 A1 | 2/2012 | Chen | | |

FOREIGN PATENT DOCUMENTS

| | | |
|---|---|---|
| CN | 1164951 A | 11/1997 |
| CN | 2410836 Y | 12/2000 |

(Continued)

OTHER PUBLICATIONS

International Search Report and Written Opinion in PCT International Application No. PCT/CN2015/085729, dated Jan. 7, 2016.

*Primary Examiner* — Brian Ensey
(74) *Attorney, Agent, or Firm* — Brooks Kushman P.C.

(57) ABSTRACT

The present disclosure provides a sound system. The sound system includes a box body and a loudspeaker arranged in the box body. An internal space of the box body is partitioned into a first chamber and a second chamber by a partition board in a sounding vibration direction of the loudspeaker. A vibration side of the loudspeaker is intercommunicated with the first chamber, and a side of the loudspeaker opposite to the vibration side is intercommunicated with the second chamber. At least one of the first chamber and the second chamber is intercommunicated with the outside.

15 Claims, 2 Drawing Sheets

(56) References Cited

FOREIGN PATENT DOCUMENTS

| | | | |
|---|---|---|---|
| CN | 201039342 | Y | 3/2008 |
| CN | 101212838 | A | 7/2008 |
| CN | 102651829 | A | 8/2012 |
| CN | 204498348 | U | 7/2015 |

* cited by examiner

SOUND SYSTEM

CROSS-REFERENCE TO RELATED APPLICATION

This application is the U.S. national phase of PCT Application No. PCT/CN2015/085729 filed on Jul. 31, 2015, which claims priority to Chinese Patent Application No. 201520236213.4 filed on Apr. 17, 2015, the disclosures of which are incorporated in their entirety by reference herein.

TECHNICAL FIELD

The present disclosure relates to the technical field of audio device, and in particular to a sound system.

BACKGROUND

A conventional large-sized display device sounds by a loudspeaker mounted in a case of the display device, or by a loudspeaker encapsulated in a simple box body. Since such loudspeaker is generally mounted on a holder directly, there exist technical problems of lack of resonance of acoustic signals, poor acoustic fidelity and being difficult in achieving an effect similar to that of human voice. Therefore, it is a research and development focus of various manufacturers to improve the acoustic quality of the large-sized display device.

SUMMARY

An object of the present disclosure is to provide a sound system with improved acoustic fidelity.

To solve the above technical problems, the present disclosure provides a sound system, comprising a box body and a loudspeaker arranged in the box body, wherein an internal space of the box body is partitioned into a first chamber and a second chamber by a partition board in a sounding vibration direction of the loudspeaker, a vibration side of the loudspeaker is intercommunicated with the first chamber, a side of the loudspeaker opposite to the vibration side is intercommunicated with the second chamber, and at least one of the first chamber and the second chamber is intercommunicated with the outside.

Optionally, the first chamber is intercommunicated with the outside via a sound wave transmission channel penetrating through a side wall of the box body, and the second chamber is intercommunicated with the outside via at least one through-hole arranged in the side wall of the box body.

Optionally, a cross-sectional area of the sound wave transmission channel is smaller than an area of the vibration side of the loudspeaker.

Optionally, the sound wave transmission channel is arranged in the first chamber, the loudspeaker is arranged in the second chamber, and the sound system further comprises a resonance cover plate, which is arranged at a position being on the exterior wall of the first chamber and in correspondence to the vibration side of the loudspeaker.

Optionally, the resonance cover plate includes a metallic plate or a ceramic plate.

Optionally, the first chamber is intercommunicated with the outside via a sound wave transmission channel penetrating through a side wall of the box body, and the second chamber is a hermetic chamber.

Optionally, a cross-sectional area of the sound wave transmission channel is smaller than an area of the vibration side of the loudspeaker.

Optionally, the loudspeaker is embedded into and fixed on the partition board.

Optionally, the sound system further includes a resonance cover plate, wherein a mounting hole is arranged at a position being on the box body of the sound system and in correspondence to the vibration side of the loudspeaker, and the resonance cover plate is mounted in the mounting hole Optionally, the resonance cover plate includes a metallic plate or a ceramic plate.

Optionally, the first chamber and the second chamber resonate to sound when the loudspeaker vibrates.

Optionally, the partition hoard serves as a holder for mounting the loudspeaker.

In the present disclosure, two chambers are formed at two sides of the sounding vibration direction of the loudspeaker in the sound system. Hence, when the loudspeaker generates a vibration, the sound is produced by resonance of the two chambers. Such sound is produced in a manner similar to the way how human make voice, and thus an acoustic fidelity of the sound system is improved.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort. Among the drawings.

REFERENCES SIGNS

Figure 1:
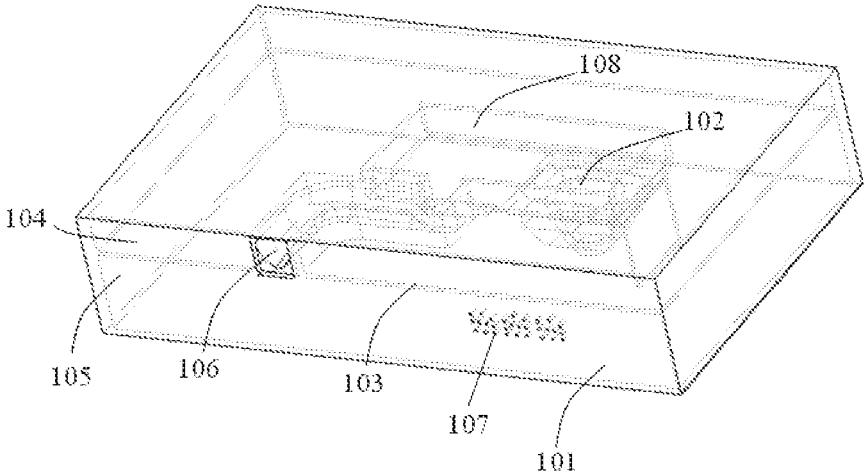
FIG. 1 is a schematic diagram of a first embodiment.

101: box body; 102: loudspeaker; 103: partition board; 104: first chamber; 105: second chamber; 106: sound wave transmission channel; 107: through-hole; 108: resonance cover plate; 109: mounting hole for resonance cover plate.

DETAILED DESCRIPTION OF THE EMBODIMENTS

The present disclosure will be described hereinafter in conjunction with the drawings and embodiments. The following embodiments are for illustrative purposes only, but shall not be used to limit the scope of the present disclosure.

In order to make the objects, the technical solutions and the advantages of the present disclosure more apparent, some technical solutions of the present disclosure will be described hereinafter in a clear and complete manner in conjunction with the drawings and embodiments. Obviously, the following embodiments are merely a part of rather than all of, the embodiments of the present disclosure, and based on these embodiments, a person skilled in the art may obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "a" are merely used to represent the existence of at least one member, rather than to limit the number thereof. Such words as "connect" "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

In the following, it is clearly and completely described the technical solutions according to the embodiments of the present disclosure. It is obvious that the described embodiments are merely some of all the embodiment of the present disclosure instead of all the embodiments, and based on these embodiments, a person skilled in the art may obtain the other embodiments, which also fall within the scope of the resent disclosure.

A sound system is provided in the present disclosure. The sound system includes a box body and a loudspeaker arranged in the box body. An internal space of the box body is partitioned into a first chamber and a second chamber by a partition board in a sounding vibration direction of the loudspeaker. A vibration side of the loudspeaker is intercommunicated with the first chamber, and a side of the loudspeaker opposite to the vibration side is intercommunicated with the second chamber. At least one of first chamber and the second chamber is intercommunicated with the outside.

In the present disclosure, two chambers are formed at two sides of the sounding vibration direction of the loudspeaker in the sound system. Hence, when the loudspeaker generates a vibration, the sound is produced by resonance of the two chambers. Such sound is produced in a manner similar to the way how human make voice, and thus an acoustic fidelity of the sound system is improved.

FIG. 1 is a schematic diagram of a first embodiment of the present disclosure. In this embodiment, it is provided a sound system. The sound system includes a box body 101 and a loudspeaker 102 arranged in the box body 101. Internal space of the box body 101 is partitioned into a first chamber 104 and a second chamber 105 by a partition hoard 103 in a sounding vibration direction of the loudspeaker 102. A vibration side of the loudspeaker 102 is intercommunicated with the first chamber 104, and a side of the loudspeaker 102 opposite to the vibration side is intercommunicated with the second chamber 105.

In the first embodiment, the first chamber 104 is intercommunicated with the outside via, a sound wave transmission channel 106 penetrating through a side wall of the box body 101; the second chamber 105 is intercommunicated with the outside via at least one through-hole 107 arranged in the side wall of the box body 101. Generally, a cross-sectional area of the sound wave transmission channel 106 is smaller than an area of the vibration side of the loudspeaker 102, so as to converge sound waves effectively.

The sound wave transmission channel 106 is located in the first chamber 104. The loudspeaker 102 is mounted in the second chamber 105 by a holder. The sound system further includes a resonance cover plate 108, which is located at a position being on the exterior wall of the first chamber 104 and in correspondence to the vibration side of the loudspeaker 102. The resonance cover plate 108 includes a metallic plate, a ceramic plate, or a plate which is made of another material and capable of enhancing a vibration effect of sound waves.

In the first embodiment, the sound system operates as follows: upon receiving an electric signal, the loudspeaker 102 generates a vibration and sounds, the vibration generated by the loudspeaker 102 is transferred to the resonance cover plate 108; while the loudspeaker 102 and the resonance cover plate 108 resonate, the first chamber 104 and the second chamber 105 form a resonance cavity; sound waves in the first chamber 104 are transmitted to the outside via the sound wave transmission channel 106, and sound waves in the second chamber 105 are transmitted to the outside via the through-holes 107 provided on the box body 101.

Figure 2:
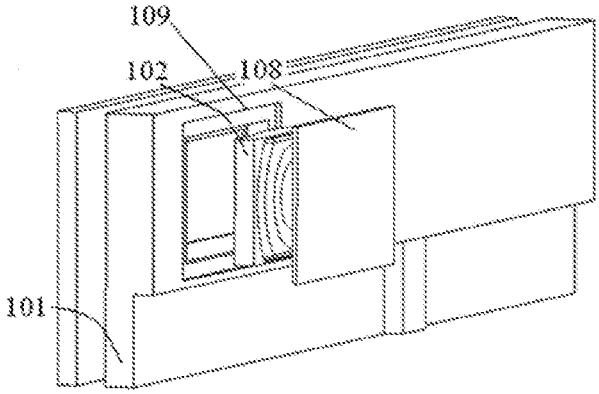
FIG. 2 is a schematic diagram of a second embodiment.
Figure 3:
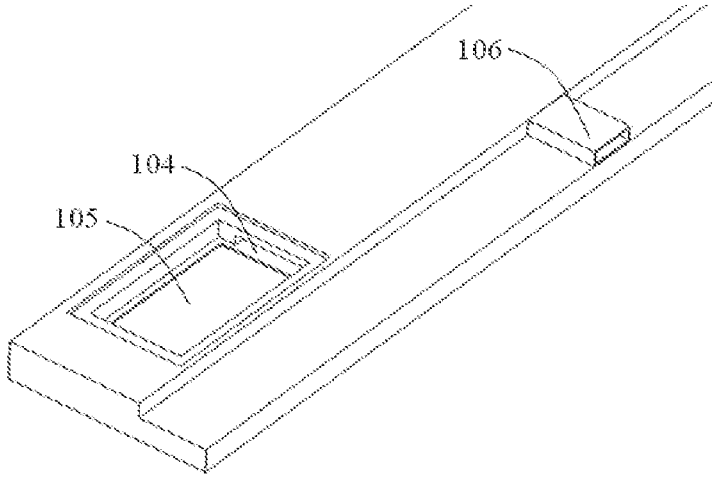
FIG. 3 is another schematic diagram of the second embodiment.
Figure 4:
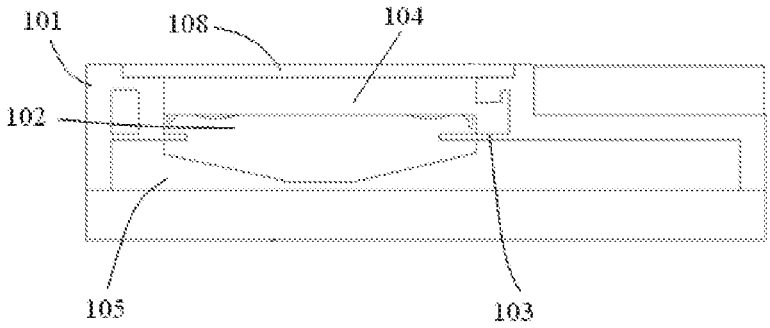
FIG. 4 is yet another diagram of the second embodiment.

FIGS. 2-4 are schematic diagrams of a second embodiment of the present disclosure. In the second embodiment, it is provided a sound system. The sound system includes a box body 101 and a loudspeaker 102 arranged in the box body 101. Internal space of the box body 101 is partitioned into a first chamber 104 and a second chamber 105 by a partition board 103 in a sounding vibration direction of the loudspeaker 102. A vibration side of the loudspeaker 102 is intercommunicated with the first chamber 104, and aside of the loudspeaker 102 opposite to the vibration side is intercommunicated with the second chamber 105.

In the second embodiment, the first chamber 104 is intercommunicated with the outside via a sound wave transmission channel 106 penetrating through a side wall of the box body 101, and the second chamber 105 is a hermetic chamber. When the loudspeaker 102 generates a vibration, the air in the first chamber 104 and the air in the second chamber 104 vibrate, so that the resonance sounding is implemented by these two chambers. Generally, a cross-sectional area of the sound wave transmission channel 106 is smaller than an area of the vibration side of the loudspeaker 102, so as to converge sound waves effectively.

As shown in FIG. 4, the loudspeaker 102 is embedded and fixed on the partition board 103. The partition board 103 not only separates these two chambers, but also serves as a holder for mounting the loudspeaker 102.

The sound system further includes a resonance cover plate 108. A mounting hole 109 is arranged at a position being on the box body 101 of the sound system and in correspondence to the vibration side of the loudspeaker 102, and the resonance cover plate 108 is mounted in the mounting hole 109. The resonance cover plate 108 includes a metallic plate, a ceramic plate, or a plate which is made of another material and capable of enhancing a vibration effect of sound waves.

In the present disclosure, two chambers are formed at two sides of the sounding vibration direction of the loudspeaker in the sound system. Hence, when the loudspeaker generates a vibration, the air in both chambers vibrates, and the sound is produced by resonance of the two chambers. Such sound is produced in a manner similar to the way how human make voice, and thus an acoustic fidelity of the sound system is improved.

It is appreciated that the above implementations are merely the preferred embodiments of the present disclosure for illustrating the principle of the present disclosure, and the present disclosure is not limited thereto. A person skilled in the art may make further modifications and improvements without departing from the principle and the spirit of the present disclosure, and these modifications and improvements shall also fall within the scope of the present disclosure.

What is claimed is:

1. A sound system, comprising a box body and a loudspeaker arranged in the box body, wherein an internal space of the box body is partitioned into a first chamber and a second chamber by a partition board in a sounding vibration direction of the loudspeaker, a vibration side of the loudspeaker is intercommunicated with the first chamber, a side of the loudspeaker opposite to the vibration side is intercommunicated with the second chamber, and at least one of the first chamber and the second chamber is intercommunicated with the outside;

the first chamber is intercommunicated with the outside via a sound wave transmission channel penetrating through a side wall of the box body, and the second chamber is a hermetic chamber; and a cross-sectional area of the sound wave transmission channel is smaller than an area of the vibration side of the loudspeaker.

2. The sound system according to claim 1, wherein the sound wave transmission channel is arranged in the first chamber, the loudspeaker is arranged in the second chamber, and the sound system further comprises a resonance cover plate, which is arranged at a position on the exterior wall of the first chamber and corresponding to the vibration side of the loudspeaker.

3. The sound system according to claim 2, wherein the resonance cover plate comprises a metallic plate or a ceramic plate.

4. The sound system according to claim 1, wherein the loudspeaker is embedded into and fixed on the partition board.

5. The sound system according to claim 4, further comprising a resonance cover plate, wherein a mounting hole is arranged at a position on the box body of the sound system and corresponding to the vibration side of the loudspeaker, and the resonance cover plate is mounted in the mounting hole.

6. The sound system according to claim 5, wherein the resonance cover plate comprises a metallic plate or a ceramic plate.

7. The sound system according to claim 1, wherein the first chamber and the second chamber resonate to sound when the loudspeaker generates a vibration.

8. The sound system according to claim 1, wherein the partition board serves as a holder for mounting the loudspeaker.

9. The sound system according to claim 4 wherein the sound wave transmission channel is arranged in the first chamber, the loudspeaker is arranged in the second chamber, and the sound system further comprises a resonance cover plate, which is arranged at a position on the exterior wall of the first chamber and corresponding to the vibration side of the loudspeaker.

10. The sound system according to claim 9, wherein the resonance cover plate comprises a metallic plate or a ceramic plate.

11. The sound system according to claim 2, wherein the loudspeaker is embedded into and fixed on the partition board.

12. The sound system according to claim 11, further comprising a resonance cover plate, wherein a mounting hole is arranged at a position on the box body of the sound system and corresponding to the vibration side of the loudspeaker, and the resonance cover plate is mounted in the mounting hole.

13. The sound system according to claim 12, wherein the resonance cover plate comprises a metallic plate or a ceramic plate.

14. The sound system according to claim 4, wherein the first chamber and the second chamber resonate to sound when the loudspeaker generates a vibration.

15. The sound system according to claim 4, wherein the partition board serves as a holder for mounting the loudspeaker.

* * * * *